US006232030B1

(12) United States Patent
Otani et al.

(10) Patent No.: US 6,232,030 B1
(45) Date of Patent: May 15, 2001

(54) TONER MANUFACTURING METHOD

(75) Inventors: Yasuhisa Otani; Toshihiro Hattori, both of Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/530,435

(22) PCT Filed: Aug. 31, 1999

(86) PCT No.: PCT/JP99/04693

§ 371 Date: May 1, 2000

§ 102(e) Date: May 1, 2000

(87) PCT Pub. No.: WO00/13064

PCT Pub. Date: Mar. 9, 2000

(30) Foreign Application Priority Data

Sep. 1, 1998 (JP) ..... 10-247414
Sep. 1, 1998 (JP) ..... 10-247415

(51) Int. Cl.[7] ..... G03G 9/08
(52) U.S. Cl. ..... 430/137
(58) Field of Search ..... 430/137

(56) References Cited

U.S. PATENT DOCUMENTS 4,379,825 * 4/1983 Mitsuhashi ..... 430/137

FOREIGN PATENT DOCUMENTS 149567 6/1991 (JP) .
249738 9/1993 (JP) .
287420 10/1995 (JP) .
308921 11/1995 (JP) .
171159 6/1998 (JP) .

* cited by examiner

*Primary Examiner*—Roland Martin
(74) *Attorney, Agent, or Firm*—Birch, Stewart, Kolasch & Birch, LLP

(57) ABSTRACT

The present invention relates to a process for manufacturing a toner comprising the step of melt-kneading a composition comprising a resin binder and a colorant using an open roller-type continuous kneader having heating and cooling functions. According to the process for manufacturing a toner, there can be manufactured a toner which is excellent in the dispersion of the colorant and/or wax, and a toner having controlled dispersibilities of the charge control agent and the wax.

9 Claims, No Drawings

TONER MANUFACTURING METHOD

This application is the national phase under 35 U.S.C. § 371 of PCT International Application No. PCT/JP99/04693 which has a International filing date of Aug. 31, 1999, which designated the United States of America.

TECHNICAL FIELD

The present invention relates to a process for manufacturing a toner usable in electrophotographic method, electrostatic printing method, magnetic recording method, and the like.

BACKGROUND ART

Elements relating to the performance of color toners include color strength and transmittance. Although the color strength and the transmittance are affected by the amount of a colorant, these properties are also greatly affected by the dispersibility of the colorant in the color toner particles. In a process for manufacturing a color toner by pulverization method, the dispersion states of the various raw materials in the color toner particles are substantially determined by the steps of mixing raw materials, and kneading the mixture.

In order to solve the above problem, Japanese Patent Laid-Open No. Hei 6-161154 discloses a technique for dispersing a water-insoluble dye and/or pigment in a resin binder by flushing method. In addition, Japanese Patent Laid-Open No. Hei 6-11895 discloses a technique of a melt-kneading process divided into two steps, comprising granulating a raw material mixture in the first kneading step; and adding additives such as a resin binder to dilute and mix the mixture in the second kneading step. However, in these attempts, there also arise some problems that specialized plurality of steps are necessitated, and that the number of steps are very large, thereby making the process complicated.

In addition, in a process using an extruder as that described in Japanese Patent Gazette No. 2677685, there arises a problem that sufficient dispersion of a colorant, a charge control agent, a wax, and the like required for a color toner cannot be carried out as the temperature of the composition increases by kneading heat.

Also, there are numerous prior arts disclosing that a wax is used as an offset inhibitor by blending it in the toner. However, as the amount of the wax blended increases, the wax in the toner is poorly dispersed, so that the wax deposits on the photoconductor in the developer device, and that the level of the triboelectric charges is lowered with the passage of time, thereby making it less likely to carry out stable development.

In order to solve these problems, Japanese Patent Laid-Open No. Hei 6-161153 discloses a technique of kneading the mixture at a set temperature (Ts), wherein the set temperature is within the range of $Tm-20° C. \leqq Ts \leqq Tm+20° C.$, wherein Tm is a melting temperature of the resin binder. However, in order to sufficiently disperse the wax blended into the toner, it is necessary to apply a strong kneading force. When a twin-screw kneader described in Japanese Patent Laid-Open No. Hei 6-161153, since the temperature of the kneaded mixture increases by 20° to 60° C. or so from the set temperature owing the generated kneading heat, the wax is re-agglomerated, and a strong kneading force cannot be applied, so that there arises a defect that a toner having excellent dispersibility of the wax cannot be obtained. Especially, this phenomenon is markedly found when a wax having a low melting point (83° C.), such as carnauba wax, is used. On the other hand, when the set temperature is lowered in consideration of the kneading heat, there arises a defect that the resin does not melt, so that kneading cannot be carried out.

DISCLOSURE OF INVENTION

An object of the present invention is to provide a process for manufacturing a toner having excellent dispersibility of a colorant and/or a wax, and a process for manufacturing a toner in which the dispersibility of the charge control agent and the wax is controlled.

These objects and other objects of the present invention will be apparent from the following description.

Specifically, the present invention relates to:

[1] a process for manufacturing a toner comprising the step of melt-kneading a composition comprising a resin binder and a colorant using an open roller-type continuous kneader having heating and cooling functions;

[2] the process according to item [1] above, wherein a plurality of feed openings are provided for melt-kneading along a shaft direction of a roller of the kneader, and wherein melt-kneading is carried out by continuously feeding 6 to 70% by weight of a resin binder to be blended at a position of 0 L to 0.5 L from a roller end at inlet side of the kneader, L being a roller length, and continuously feeding 50 to 100% by weight of a colorant at a position 0 L to 0.5 L;

[3] the process according to item [1] above, wherein a composition comprising a resin binder, a colorant, and a wax, wherein the content of the wax is 3 to 20 parts by weight, based on 100 parts by weight of the resin binder, is melt-kneaded using the kneader under the conditions that a temperature of a kneaded mixture during melt-kneading is [Tm−20° C.] to [Tm+20° C.], wherein Tm is a melting temperature of the resin binder; and

[4] the process according to item [1] above, wherein a plurality of feed openings are provided for melt-kneading along a shaft direction of a roller of the kneader, and wherein melt-kneading is carried out by continuously feeding a kneaded mixture previously prepared by melt-blending a colorant with a resin binder, a resin binder, and a charge control agent, at a position of 0 L to 0.9 L from a roller end at inlet side of the kneader, L being a roller length.

BEST MODE FOR CARRYING OUT THE INVENTION

The resin binder usable in the present invention is not particularly limited, and those known resin binders for black toners or for color toners can be used. For instance, there may be used resin binders such as polyester resins and vinyl resins described at Page 3, Column 4, Line 37 to Page 6, Column 10, Line 10 of Japanese Patent Laid-Open No. Hei 7-98518; and resin binders obtained by mixing a releasing agent with a raw material monomer mixture, and carrying out polymerization reaction.

The content of the resin binder is preferably from 55 to 98% by weight, more preferably from 80 to 95% by weight, of the composition.

The colorant is not particularly limited, and those known colorants for black toners or for color toners can be used. The colorant includes black colorants, yellow pigments, red or crimson pigments, blue pigments, green pigments, and the like, and these colorants may be used alone, or in admixture of two or more kinds.

The content of the colorant is preferably from 2 to 15% by weight, more preferably from 3 to 10% by weight, of the composition.

In addition, the open roller-type continuous kneader having heating and cooling functions usable in the present invention includes an open roller-type continuous kneader comprising two rollers provided in proximity with and in parallel to each other. Each roller can be heated or cooled by passing through a heating medium. Specifically, one roller is a heat roller, and the other roller is a cooling roller, to thereby carry out temperature regulation.

The gap between the two rollers is preferably from 0.1 to 10 mm, more preferably from 0.1 to 3 mm. The structure, the size, the material, and the like of each roller is not particularly limited, and the roller surface may be smooth, or it may be wavy or rugged.

In addition, the number of rotations of the roller is preferably at a peripheral speed of from 2 to 100 m/min, and the ratio of the number of rotations of two rollers (number of rotations of the cooling roller/number of rotations of the heat roller) is preferably from 1/10 to 9/10.

Also, a desired kneading force can be obtained by appropriately adjusting the kneading temperature and the number of rotations of the roller.

Incidentally, in order to feed the raw materials into the open roller-type continuous kneader, there may be employed, for instance, a table feeder, and the like.

In addition, before feeding the raw materials, each of the raw materials may be previously mixed by using a mixer. The mixer is not particularly limited, and the mixer include high-speed agitation mixers such as Henschel mixer (manufactured by MITSUI MINING COMPANY, LTD.), High-Speed Mixer (manufactured by Fukae Powtec Corp.), and Löbdige Mixer (manufactured by Matsubo).

The process for manufacturing a toner used in the open roller-type continuous kneader described above includes the following embodiments:

[Embodiment A] a process for manufacturing a toner, wherein a plurality of feed openings are provided for melt-kneading along a shaft direction of a roller of the kneader, and wherein melt-kneading is carried out by continuously feeding 6 to 70% by weight of a resin binder to be blended at a position of 0 L to 0.5 L from a roller end at inlet side of the kneader, L being a roller length, and continuously feeding 50 to 100% by weight of a colorant at a position 0 L to 0.5 L;

[Embodiment B] a process for manufacturing a toner, wherein a composition comprising a resin binder, a colorant, and a wax, wherein the content of the wax is 3 to 20 parts by weight, based on 100 parts by weight of the resin binder, is melt-kneaded using the kneader under the conditions that a temperature of a kneaded mixture during melt-kneading is [Tm−20° C.] to [Tm+20° C.], wherein Tm is a melting temperature of the resin binder; and

[Embodiment C] a process for manufacturing a toner, wherein a plurality of feed openings are provided for melt-kneading along a shaft direction of a roller of the kneader, and wherein melt-kneading is carried out by continuously feeding a kneaded mixture previously prepared by melt-blending a colorant with a resin binder, a resin binder, and a charge control agent, at a position of 0 L to 0.9 L from a roller end at inlet side of the kneader, L being a roller length.

In the process of Embodiment A, one of the large features resides in that an open roller-type continuous kneader having heating and cooling functions is used for melt-kneading a composition comprising a resin binder and a colorant, and that the raw materials are fed from a plurality of feed openings. By having this feature, the dispersibility of the colorant, and the like can be easily controlled, and further the raw materials of the composition can be kneaded at once, so that there are exhibited excellent effects that the time period required for manufacturing the toner can be markedly shortened, and further that a toner having excellent dispersion of the colorant can be easily manufactured.

As the open roller-type continuous kneader, there can be used a kneader provided with a plurality of feed openings for raw materials along the shaft direction of the roller. In addition, it is preferable that the temperature of a heat roller is adjusted to a temperature near a melting point of a resin binder, and the temperature of a cooling roller is adjusted to a temperature of not more than a melting point of the resin binder. Here, the term "melting temperature (Tm)" refers to a temperature corresponding to a half the height of a flow-out initiation point to a flow-out termination point, when a 1 $cm^3$ sample is melted and flowed out by using a Koka-type flow tester ("CFT-500," manufactured by Shimadzu Corporation), under the conditions of pore diameter of dice: 1 mm, length: 1 mm, load: 20 $kg/cm^2$ (196 $N/cm^2$), and heating rate: 6° C./min.

In this Embodiment A, it is preferable to carry out kneading by feeding the raw materials on the upper surface of the roller or between the two rollers from a plurality of feed openings provided along the shaft direction of the roller, with rotating the two rollers mentioned above in the clockwise direction and a counter direction thereof.

When the raw materials are melt-kneaded with the open roller-type continuous kneader mentioned above, it is preferable to feed the resin binder from a plurality of feed openings along the shaft direction of the roller, in order to sufficiently disperse the colorant, and the like in the resin binder. From the viewpoints of obtaining a sufficient retention time and improving the dispersibility of the colorant, and the like, the resin binder to be blended is fed from a position of 0 L to 0.5 L in an amount of 6% by weight or more, preferably 10% by weight or more, and 70% by weight or less, preferably 50% by weight or less. Especially, it is more preferable that the resin binder is fed from a position of 0 L to 0.3 L in an amount of from 6 to 30% by weight of the resin binder to be blended. The concentration of the colorant in the kneaded mixture is increased by regulating the amount of resin binder in the above positions, so that the dispersibility can be improved by increasing the viscosity of the kneaded mixture, whereby causing a stronger kneading force.

The colorant is preferably fed from one or more feed openings along the shaft direction of the roller for sufficiently dispersing the colorant. From the viewpoint of improving the dispersibility, the colorant to be blended is fed from one or more openings from a position of 0 L to 0.5 L, preferably from a position of 0 L to 0.3 L, in an amount of 50% by weight or more, preferably 80% by weight or more and 100% by weight or less, to thereby highly disperse the colorant.

In addition, it is desired that the content of the colorant fed from a position of 0 to 0.5 L is 3% by weight or more, preferably 5% by weight or more, of the composition, from the viewpoints of increasing the viscosity of the composition, obtaining a stronger kneading force and improving the dispersibility, and that the content is 50% by weight or less, preferably 30% by weight or less, of the composition, from the viewpoint of well kneading a large amount of the colorant in the resin binder.

Also, the composition usable in this Embodiment A may further comprise a charge control agent, a wax, and the like.

The charge control agent is not particularly limited, and those known charge control agents for black toners or for color toners can be used. The charge control agent for negatively charged toner includes chromium complexes of azo dyes; iron complexes of azo dyes; cobalt complexes of azo dyes; chromium, zinc, aluminum or boron complexes of salicylic acid or their derivatives, or salt compounds thereof; chromium, zinc, aluminum or boron complexes of naphthoic acid or their derivatives, or salt compounds thereof; chromium, zinc, aluminum or boron complexes of benzilic acid or their derivatives, or salt compounds thereof; surfactants such as long-chain alkyl carboxylates and long-chain alkyl sulfonates. In addition, the charge control agent for positively charged toner includes nigrosine dyes and their derivatives, triphenylmethane derivatives, derivatives of quaternary ammonium salts, quaternary phosphonium salts, quaternary pyridinium salts, guanidine salts, amidine salts, and the like.

It is preferable that the charge control agent is fed from one or more feed openings at a position 0 L to 0.9 L in accordance with the desired dispersibility. In addition, when a plurality of charge control agents are used, the feed positions can be varied depending on the respective targeted dispersibility. Incidentally, while its effects are enhanced as the dispersibility of the charge control agent is increased, the effects rather are decreased when the dispersibility thereof is exceedingly increased. Therefore, it is preferable to control the average particle diameter (particle diameter of dispersed particles of the charge control agent) so as to have optimal dispersibility of the charge control agent used. It is desired that the optimal average particle diameter of the charge control agent in the kneaded mixture is from 0.1 to 3 $\mu$m, preferably from 0.1 to 2 $\mu$m. The average particle diameter can be calculated from the following equation (I):

$$\text{Average Particle Diameter } [\mu\text{m}] = \frac{\sum n(1/2)a \cdot (1/2)b}{\sum n(1/2)(a+b)} \quad (1)$$

wherein a is a length [$\mu$m] of a particle; b is a breadth [$\mu$m] of a particle; and n is a number of particles determined, wherein the length and the width were obtained by observation by transmission electron microscope.

In addition, it is desired that the content of the charge control agent in this Embodiment A is 0.1% by weight or more, preferably 0.5% by weight or more, of the final composition comprising a charge control agent, a wax, and the like, from the viewpoint of imparting electric charges, and it is desired that the content is 15% by weight or less, preferably 10% by weight or less, from the viewpoint of the transparency as the charge control agent and the toner.

The wax includes natural waxes and synthetic waxes such as silicone-based waxes, higher fatty acids, polyolefins, and low-molecular polymers. Among them, the natural waxes are preferably used, and concrete examples thereof include carnauba wax, rice wax, candelilla wax and bees wax.

It is preferable that the wax is fed from one or more feed openings at a position 0 L to 0.9 L in accordance with the desired dispersibility. In addition, when a plural waxes are used, each of the feed positions can be varied in accordance with the respective targeted dispersibility. Since the wax in the toner exists in a separated state without being compatible with the resin binder, when the average particle diameter of the wax (particle diameter of the dispersed particles of the wax) is too large, the wax is exposed on the toner surface, so that the wax deposits on the photoconductor in the developer device, and the level of the triboelectric charges is lowered with the passage of time, thereby making it less likely to carry out stable development. On the other hand, when the average particle diameter of the wax is too small, a speed for bleeding out the wax is delayed during fixing, so that the wax does not act as an offset inhibitor. Therefore, it is preferable that the average particle diameter of the wax as calculated by the equation (1) is from 0.1 to 0.3 D $\mu$m, on the basis of the weight-average particle diameter (D) of the toner. Concretely, it is desired that the average particle diameter is from 0.5 to 3 $\mu$m. Here, the weight-average particle diameter (D) of the toner is determined by using a Coulter counter (Beckman Coulter; aperture: 100 $\mu$m).

In addition, it is desired that the content of the wax in this Embodiment A is 1% by weight or more, preferably 3% by weight or more, of the final composition, from the viewpoint of exhibiting an excellent offset inhibitory effect, and it is desired that the content is 20% by weight or less, preferably 15% by weight or less, of the final composition, from the viewpoint of suppressing the formation of filming onto a photoconductor.

In the process for manufacturing a toner of Embodiment B, one of the largest features resides in that the composition is melt-kneaded using an open roller-type continuous kneader having heating and cooling functions, under the conditions that the temperature of the kneaded mixture during melt-kneading is [Tm−20° C.] to [Tm+20° C.]. Since the open roller-type continuous kneader comprises a heat roller and a cooling roller and a melt-kneading part of the kneader is an open-type, the kneading heat generated during melt-kneading can be easily dissipated, which is different from the conventionally used twin-screw extruder. In this Embodiment B, by melt-kneading the kneaded mixture under the conditions that the temperature of the kneaded mixture during melt-kneading is [Tm−20° C.] to [Tm+20° C.] using the open roller-type continuous kneader, there is exhibited an excellent effect that the toner having excellent dispersibility of the wax can be easily manufactured.

In this Embodiment B, the temperature is controlled by using a heat roller and a cooling roller of the open roller-type continuous kneader so as to have the temperature of the kneaded mixture of [Tm−20° C.] to [Tm+20° C.], preferably [Tm−10° C.] to [Tm+10° C.]. Here, the temperature of the kneaded mixture refers to the temperature of the kneaded mixture itself deposited on the roller. The melting temperature (Tm) refers to a temperature as defined in Embodiment A.

When a temperature-controlled open roller-type continuous kneader as described above is used, the kneading force expressed by required power (Pv) is determined by a combination of the temperature of the kneaded mixture and the number of rotations of the roller. It is desired that the Pv is preferably 0.05 kw Hr/kg or more, from the viewpoint of obtaining a sufficient dispersion of the wax in the kneaded mixture, and that the Pv is preferably 1.5 kw Hr/kg or less, more preferably 0.8 kw Hr/kg or less, from the viewpoint of obtaining an appropriate average particle diameter for the wax in the kneaded mixture. Here, Pv is obtained by dividing the sum of powers for each roller by a feed amount of the composition, wherein an actual power applied to each roller can be determined by measuring the output current value or torque value of the motor and the number of rotations.

The wax usable in this Embodiment B may be the same ones as those usable in Embodiment A described above. It is desired that the wax has a melting point (Mp) of 50° to 150° C. In this Embodiment B, the effects of the present invention are especially more remarkable in a case where a wax having a melting point lower than Tm of the resin binder. Therefore, especially, it is more preferable to use a wax having a low-melting point of 50° to 100° C. Therefore, when the wax acts as an offset inhibitor, it is desired that the melting point satisfies the condition of Mp≦[Tm+20° C.], preferably Mp≦Tm, in reference to the melting temperature (Tm) of the resin binder. Here, Mp is referred to as a temperature at which states are transformed from crystalline to amorphous when heated at 10° C./min by using a polarizing microscope.

In the wax, drastic viscosity changes take place near its melting point. Specifically, when the temperature exceeds the melting point, the viscosity exhibits a drastic decrease to a level of about several mPa·s. Therefore, when the wax is contained in the composition and kneaded, if a wax having a low melting point relative to Tm of a resin binder is used, the dispersed wax is undesirably re-agglomerated in a device where the temperature of the kneaded mixture is elevated by the kneading heat as in the case of the twin-screw extruder-kneader, so that the average particle diameter of the wax after cooling is extremely large.

On the other hand, in a case of the open roller-type continuous kneader having heating and cooling functions, there is no cumulative heat of the kneading heat because a melt-kneading part is an open type, and further the re-agglomeration of the low-melting point wax is suppressed by cooling with a cooling roller without depositing the kneaded mixture, and thereby the wax can be highly dispersed.

It is desired that the wax in this Embodiment B is contained in an amount of from 3 to 20 parts by weight, preferably from 3 to 15 parts by weight, particularly preferably from 5 to 10 parts by weight, based on 100 parts by weight of the resin binder. Especially, in a case of fixing without using an oil feeding device, it is preferable that the wax is contained in an amount of 5 to 10 parts by weight.

The toner can be obtained by solidifying, pulverizing and classifying the kneaded mixture, and the weight-average particle diameter (D) of the toner is preferably from 3 to 15 μm. Also, the average particle diameter of the wax in the toner may be the same as in Embodiment A mentioned above.

In addition, the composition usable in this Embodiment B may comprise a charge control agent. The charge control agent usable in this Embodiment B includes those listed in Embodiment A mentioned above. The content of the charge control agent is preferably from 0.5 to 6% by weight, more preferably from 0.5 to 4% by weight, of the composition.

In the process of Embodiment C, one of the largest features resides in the use of a kneaded mixture previously prepared by melt-blending a colorant with a resin binder, as in the case of "master-batch", during melt-kneading the mixture using the open roller-type continuous kneader having heating and cooling functions. By using the above kneaded mixture, there is exhibited an excellent effect that the colorant, and the like can be sufficiently dispersed in the resin binder.

In this Embodiment C, the temperature of the heat roller of the open roller-type continuous kneader is adjusted to a temperature near the melting temperature of the resin binder, and the temperature of the cooling roller is adjusted to a temperature not more than the melting temperature of the resin binder. Here, the melting temperature (Tm) refers to a temperature as defined in Embodiment A.

In this Embodiment C, it is preferable to carry out kneading by feeding the raw materials on the upper surface of the roller or between the two rollers from a plurality of feed openings provided along the shaft direction of the roller, with rotating the two rollers mentioned above in the clockwise direction and a counter direction thereof.

The content of the resin binder is preferably from 50 to 90% by weight, more preferably from 60 to 80% by weight, of the kneaded mixture usable in this Embodiment C.

In addition, the content of the resin binder in this Embodiment C is preferably from 50 to 95% by weight, more preferably from 80 to 95% by weight, of the final composition.

Incidentally, in this Embodiment C, the resin binder is used by including in the kneaded mixture mentioned above, and at the same time used by separately adding in the open roller-type continuous kneader.

The content of the colorant is preferably from 10 to 50% by weight, more preferably from 20 to 40% by weight, of the kneaded mixture.

In addition, the content of the colorant is preferably from 2 to 15% by weight, more preferably from 3 to 10% by weight, of the final composition.

The process for manufacturing the kneaded mixture mentioned above is not particularly limited. For instance, the kneaded mixture may be prepared by subjecting to master-batch by using a known manufacturing device, such as a heat roller mill, a batch-type kneader, a twin-screw extruder or an open roller-type continuous kneader, at a temperature of [Tm−20° C.] to [Tm+50° C.], in reference to the melting temperature (Tm) of the resin binder.

The kneaded mixture and the resin binder can be fed to the open roller-type continuous kneader from one or more feed openings at a position of 0 L to 0.9 L, preferably at a position of 0 L to 0.5 L, more preferably at a position of 0 L to 0.3 L, from the viewpoint of further improving the dispersibility of the colorant.

The charge control agent usable in this Embodiment C may be the same ones usable in Embodiment A mentioned above. The charge control agent is preferably fed from one or more feed openings at a position of 0 L to 0.9 L, preferably without overlapping at a position of 0 L to 0.8 L, more preferably at a position of 0.2 L to 0.7 L, in accordance with the desired dispersibility. In addition, when a plural charge control agents are used, their feed positions can be varied in accordance with the respective targeted dispersibility. Incidentally, in the same manner as in Embodiment A, it is desired that the optimal average particle diameter of the charge control agent in the kneaded mixture is from 0.1 to 3 μm, preferably from 0.1 to 2 μm. In order to highly disperse the charge control agent, it is preferable that the kneading heat during kneading is removed when the open roller-type continuous kneader is used, so that the viscosity of the kneaded mixture is increased, thereby generating an even stronger dispersion force.

In addition, it is desired that the content of the charge control agent in this Embodiment C is 0.1% by weight or more, preferably 0.5% by weight or more, of the final composition, from the viewpoint of imparting electric charges, and it is desired that the content is 15% by weight or less, preferably 10% by weight or less, of the final composition, from the viewpoint of the transparency of the charge control agent and the toner.

In addition, the composition usable in this Embodiment C may further comprise a wax, and the like. The wax may be the same ones as those usable in Embodiment A mentioned above.

It is preferable that the wax is fed from one or more feed openings at a position of 0 L to 0.9 L, preferably at a position of 0 L to 0.8 L, more preferably at a position of 0 L to 0.6 L, in accordance with the desired dispersibility. Also, when a plural waxes are used, their feed positions can be varied in accordance with the respective targeted dispersibility. Since the wax in the toner exists in a separated state without being compatible with the resin binder, when the average particle diameter of the wax is too large, the wax is exposed on the toner surface, so that the wax deposits on the photoconductor in the developer device, and the level of the triboelectric charges is lowered with the passage of time, thereby making it less likely to carry out stable development. On the other hand, when the average particle diameter of the wax is too small, a speed for bleeding out the wax is delayed during fixing, so that the wax does not act as an offset inhibitor. Therefore, it is preferable that the average particle diameter of the wax as calculated by the equation (1) is from 0.1 to 0.3 D $\mu$m, on the basis of the weight-average particle diameter (D) of the toner. Concretely, it is desired that the average particle diameter is from 0.5 to 3 $\mu$m.

In addition, it is desired that the content of the wax in this Embodiment C is 1% by weight or more, preferably 3% by weight or more, of the final composition, from the viewpoint of exhibiting an excellent offset inhibition effect, and it is desired that the content is 20% by weight or less, preferably 15% by weight or less, of the final composition, from the viewpoint of suppressing the formation of filming onto a photoconductor.

The kneaded mixture obtained by the process of three embodiments described above can be continuously discharged from the open roller-type continuous kneader. The resulting kneaded mixture is treated by known processes such as cooling, thereafter solidification, pulverization and classification, to thereby manufacture a toner.

The cooling device usable for cooling includes, for instance, a cooling belt, and the like.

The pulverization device usable for pulverization includes, for instance, jet mills, collision plate mills, rotatable mechanical mills, and the like.

The classifier usable for classification includes, for instance, air classifiers, inertia classifiers, sieve classifiers, and the like.

The resulting toner is excellent in the dispersibility of the colorant and the wax, and further in the dispersibility of the charge control agent, and the like.

When the resulting toner is applied to printing methods such as electrophotographic method, electrostatic printing method, and magnetic recording method, there are exhibited excellent effects that the toner does not cause the formation of filming onto the photoconductor of the printing device, and that fixed images are stable even after printing.

EXAMPLES

Composition (1)

Polyester resin [glass transition point (Tg): 60° C., melting temperature Tm: 110° C. (acid components: 40 parts by weight of terephthalic acid and 60 parts by weight of fumaric acid; and alcohol components: 100 parts by weight of polyoxyethylene (2.0)-2,2-bis (4-hydroxyphenyl)propane)]
100 parts by weight Copper phthalocyanine pigment (C.I. Pigment Blue 15:3)
5 parts by weight Incidentally, the glass transition point refers to the temperature of an intersection of the extension of the baseline of not more than the glass transition temperature and the tangential line showing the maximum inclination between the kickoff the peak and the top thereof when the thermal hysteresis is determined by using a differential scanning calorimeter (made commercially available by Seiko Instruments, Inc. under the trade name: "DSC 210"), by the steps of raising the temperature of a sample to 200° C., allowing it to stand at the same temperature for 3 minutes, cooling the sample to room temperature at a cooling rate of 10° C./min, and heating the cooled sample at a temperature raise rate of 10° C./min.

Examples 1 to 3

To an open roller-type continuous kneader (made commercially available by MITSUI MINING COMPANY, LIMITED under the trade name: KNEADEX) were continuously fed 1.5 kg of the raw materials of the above Composition (1) using a table feeder. The feed position and the feed amount of each of the raw materials during this process are shown in Table 1. Incidentally, when the feed position of each of the raw materials was the same, a mixture obtained by introducing each of the raw materials into a mixer Henschel mixer (effective capacity: 10 L), and mixing the components at a rotational speed of impellers of 2500 rotations/min for 1 minute, was used.

The open roller-type continuous kneader used during the process had a roller having an outer diameter of 0.14 [m] and an effective length of 0.8 [m]. The operating conditions were as follows: a rotational speed of a high-rotation side roller (front roller) was 75 rotations/min; a rotational speed of a low-rotation side roller (rear roller) was 50 rotations/min; a gap between the rollers was 0.0001 m; temperatures of the heating medium and the cooling medium within the rollers were 100° C. on the raw material-introducing side and 100° C. on the kneaded mixture-discharging side of the high-rotation side roller, and 30° C. on the raw material-introducing side and 30° C. on the kneaded mixture-discharging side of the low-rotation side roller; a feeding rate of the raw material mixture was 5 kg/Hr; and an average residence time was about 5 minutes.

The resulting kneaded mixture for a toner was cooled on a cooling belt, and thereafter roughly pulverized by using a mill having a screen having a diameter $\phi$ of 2 [mm]. Subsequently, the roughly pulverized product was pulverized by using a collision plate-type jet mill, and the coarse granules and fine powders were further eliminated by using a cyclone-type air classifier, to give a cyan toner having a weight-average particle diameter of 9 $\mu$m. Incidentally, the weight-average particle diameter of the toner was determined by using Coulter counter. Further, 2 parts by weight of a colloidal silica was externally added, based on 100 parts by weight of the resulting toner, to give a developer.

A printing test was carried out using the obtained developer, and the color strength and the transmittance of each toner used were examined for each of the developers. Incidentally, the printing test was carried out by using a commercially available nonmagnetic one-component type full-color electrophotographic recording device comprising a developing roller having a diameter of 15 mm. First, as to the image density, a solid image was formed using an OHP sheet so as to have an amount of toner on the sheet of 0.5 mg/cm$^2$, and the image was fixed at a temperature of 160° C. With adjusting the image density to 1.3, the color strength and the transmittance of the resulting fixed images were evaluated with HAZE values. The results are shown in Table 1. Incidentally, HAZE values are expressed by the following equation. Here, the more excellent the dispersibility of the colorant, the smaller the diffusion transmittance, and the HAZE value is reduced accordingly. The HAZE value of a color toner is preferably 22% or less. Further, the fixed images obtained after continuously copying 10000 sheets were also similarly evaluated (hereinafter referred to as "durability printing test"). As a result, stable fixed images could be obtained in each case.

$$\text{HAZE value} = \frac{\text{Diffusion Transmittance}}{\text{Entire Transmittance}} \times 100\ [\%] \quad (2)$$

Comparative Example 1

Preparation procedures including melt-kneading were carried out using Composition (1) under the same conditions as in Example 1, except that the feed position and the feed amount of each of the raw materials are as shown in Table 1, to give a toner (weight-average particle diameter: 9 μm). When the pigment dispersion in this toner was determined by using a HAZE meter, HAZE value was 28%, so that excellent fixed images could not be obtained. In addition, stable fixed images could not be obtained in a 10000-sheet durability printing test.

Composition (2)

Polyester resin [glass transition point (Tg): 60° C., softening point Tm: 110° C. (acid components: 40 parts by weight of terephthalic acid and 60 parts by weight of fumaric acid; and alcohol components: 100 parts by weight of polyoxyethylene(2.0)-2,2-bis(4-hydroxyphenyl)propane)]
100 parts by weight Copper phthalocyanine pigment (C.I. Pigment Blue 15:3)
5 parts by weight Charge control agent (chromium complex of salicylic acid, trade name: E-84, made commercially available by Orient Chemical Co., Ltd.)
3 parts by weight Example 4

The procedures such as melt-kneading were carried out under the same conditions as in Example 1, except that the feed position and the feed amount of each of the raw materials are as shown in Table 1 in Composition (2), to give a toner (weight-average particle diameter: 9 μm). The toner obtained was observed by using a transmission electron microscope (magnification: 2500) for the particle diameter of the charge control agent. As a result, the charge control agent could be dispersed in an average particle diameter of 0.3 μm. When the pigment dispersion in this toner was determined by using a HAZE meter, HAZE value was 18%, so that excellent fixed images could be obtained. Further, in a 10000-sheet durability printing test, stable fixed images could be obtained.

Example 5

The procedures such as melt-kneading were carried out under the same conditions as in Example 1, except that 100% of the charge control agent in Composition (2) was fed at a position of 0.5 L, to give a toner (weight-average particle diameter: 9 μm). The toner obtained was observed by using a transmission electron microscope (magnification: 2500) for the particle diameter of the charge control agent. As a result, the charge control agent could be dispersed in an average particle diameter of 0.5 μm. When the pigment dispersion in this toner was determined by using a HAZE meter, HAZE value was 19%, so that excellent fixed images could be obtained. Further, in a 10000-sheet durability printing test, stable fixed images could be obtained.

Comparative Example 2

The procedures such as melt-kneading were carried out under the same conditions as in Comparative Example 1, except that 100% of the charge control agent in Composition (2) was fed at a position of 0.5 L, to give a toner (weight-average particle diameter: 9 μm). The toner obtained was observed by using a transmission electron microscope (magnification: 2500) for the particle diameter of the charge control agent. As a result, the charge control agent could be dispersed in an average particle diameter of 3.5 μm. When the pigment dispersion in this toner was determined by using a HAZE meter, HAZE value was 26%, so that excellent fixed images could not be obtained. Further, in a 10000-sheet durability printing test, there were caused background, decrease in the transfer ratio and uneven development, owing to poor dispersion of the charge control agent.

Composition (3)

Polyester resin [glass transition point (Tg): 60° C., melting temperature Tm: 110° C. (acid components: 40 parts by weight of terephthalic acid and 60 parts by weight of fumaric acid; and alcohol components: 100 parts by weight of polyoxyethylene(2.0)-2,2-bis(4-hydroxyphenyl)propane)]
100 parts by weight Copper phthalocyanine pigment (C.I. Pigment Blue 15:3)
3 parts by weight Carnauba wax
10 parts by weight Example 6

The procedures such as melt-kneading were carried out under the same conditions as in Example 1, except that the feed position and the feed amount of each of the raw materials are as shown in Table 1 in Composition (3), to give a toner (weight-average particle diameter: 9 μm). The toner obtained was observed by using a transmission electron microscope (magnification: 2500) for the particle diameter of the wax. As a result, the wax could be dispersed in an average particle diameter of 1.5 μm. When the pigment dispersion in this toner was determined by using a HAZE meter, HAZE value was 22%, indicating an excellent dispersion, so that excellent fixed images could be obtained.

Example 7

The procedures such as melt-kneading were carried out under the same conditions as in Example 1, except that 100% of the wax in Composition (3) was fed at a position of 0.5 L from the inlet side, to give a toner (weight-average particle diameter: 9 μm). The toner obtained was observed by using a transmission electron microscope (magnification: 2500) for the particle diameter of the wax. As a result, the wax could be dispersed in an average particle diameter of 1.5 μm. When the pigment dispersion in this toner was determined by using a HAZE meter, HAZE value was 17%, indicating an excellent dispersion, so that excellent fixed images could be obtained. Further, in a 10000-sheet durability printing test, stable fixed images could be obtained in an excellent state with no formation of filming on a photoconductor.

Comparative Example 3

The procedures such as melt-kneading were carried out under the same conditions as in Comparative Example 1, except that 100% of the wax in Composition (3) was fed at a position of 0.5 L from the inlet side, to give a toner (weight-average particle diameter: 9 μm). The toner obtained was observed by using a transmission electron microscope (magnification: 2500) for the particle diameter of the wax. As a result, the wax could be dispersed in an average particle diameter of 0.5 μm. When the pigment dispersion in this toner was determined by using a HAZE meter, HAZE value was 25%, so that excellent dispersion could not be obtained. Accordingly, the target image density could not be obtained.

TABLE 1

| | Resin Binder | | | | | | Colorant | | | | Charge Control Agent | | Carnauba Wax | | |
|---|---|---|---|---|---|---|---|---|---|---|---|---|---|---|---|
| | Feed Position and Feed Amount* | | Feed Position and Feed Amount | | Feed Position and Feed Amount | | Feed Position and Feed Amount | | Feed Position and Feed Amount | | Feed Position and Feed Amount | | Feed Position and Feed Amount | | HAZE Value (%) |
| Example Nos. | | | | | | | | | | | | | | | |
| 1 | 0 L | 60 | 0.6 L | 40 | — | — | 0 L | 100 | — | — | — | — | — | — | 20 |
| 2 | 0 L | 30 | 0.6 L | 70 | — | — | 0 L | 100 | — | — | — | — | — | — | 17 |
| 3 | 0 L | 10 | 0.6 L | 90 | — | — | 0 L | 100 | — | — | — | — | — | — | 15 |
| 4 | 0 L | 30 | 0.5 L | 30 | 0.6 L | 40 | 0 L | 100 | — | — | 0.5 L | 100 | — | — | 18 |
| 5 | 0 L | 60 | 0.6 L | 40 | — | — | 0 L | 100 | — | — | 0.5 L | 100 | — | — | 19 |
| 6 | 0 L | 60 | 0.6 L | 40 | — | — | 0 L | 60 | 0.6 L | 40 | — | — | 0.5 L | 100 | 22 |
| 7 | 0 L | 60 | 0.6 L | 40 | — | — | 0 L | 100 | — | — | — | — | 0.5 L | 100 | 17 |
| Comparative Example Nos. | | | | | | | | | | | | | | | |
| 1 | 0 L | 100 | — | — | — | — | 0 L | 100 | — | — | — | — | — | — | 28 |
| 2 | 0 L | 100 | — | — | — | — | 0 L | 100 | — | — | 0.5 L | 100 | — | — | 26 |
| 3 | 0 L | 100 | — | — | — | — | 0 L | 100 | — | — | — | — | 0.5 L | 100 | 25 |

*The feed amount is expressed as a divided proportion on part-by-weight basis.

As is clear from the results shown in Table 1, since each of the toners obtained in Examples 1 to 7 has a lower HAZE value, each of the toners is excellent in the dispersibility of the colorant, as compared to the toners obtained in Comparative Examples 1 to 3.

In addition, in the toners obtained in Examples 4 and 5, excellent fixed images can be obtained, and stable fixed images can be obtained in the 10000-sheet durability printing test, so that the dispersibility of the charge control agent is preferable, as compared to that of the toner obtained in Comparative Example 2.

Further, in the toners obtained in Examples 6 and 7, excellent fixed images can be obtained, and stable fixed images can be obtained in the 10000-sheet durability printing test, so that the dispersibility of the wax is preferable, as compared to that of the toner obtained in Comparative Example 3.

Examples 8 to 10, and Comparative Example 4

A pre-mixing was carried out as described below by using Henschel mixer (effective capacity: 10 liters). To the mixer were introduced 1.5 kg of the raw materials of the above Composition (3), and the components were mixed at a rotational speed of impellers of 2500 rotations/min for 1 minute.

The obtained mixture was fed into an open roller-type continuous kneader (made commercially available by MITSUI MINING COMPANY, LIMITED under the trade name: KNEADEX) by using a table feeder, and kneaded to give a kneaded mixture.

The open roller-type continuous kneader used during the process had a roller having an outer diameter of 0.14 [m] and an effective length of 0.8 [m]. The operating conditions were: a rotational speed of a high-rotation side roller (front roller) of 75 rotations/min; a rotational speed of a low-rotation side roller (rear roller) of 50 rotations/min; and a gap between the rollers of 0.0001 [m]. With respect to temperatures of the heating medium and the cooling medium within the rollers, the temperatures of the raw material-introducing side and the kneaded mixture-discharging side of the high-rotation side roller, and the temperatures of the raw material-introducing side and the kneaded mixture-discharging side of the low-rotation side roller, were set as shown in Table 2. In addition, a feeding rate of the raw material mixture was 5 kg/Hr, and an average residence time was about 5 minutes. Incidentally, the temperatures of the kneaded mixtures and the kneading forces are shown in Table 3.

The resulting kneaded mixture for a toner was cooled on a cooling belt, and thereafter roughly pulverized by using a mill having a screen having a diameter ϕ of 2 [mm]. Subsequently, the roughly pulverized product was pulverized by using a collision plate-type jet mill, and the coarse granules and fine powders were eliminated by using a cyclone-type air classifier, to give a cyan toner having a weight-average particle diameter of 9 [μm]. Incidentally, the weight-average particle diameter of the toner was determined by using Coulter counter. Two parts by weight of a colloidal silica was externally added, based on 100 parts by weight of the resulting toner, to give a developer.

About 200 wax particles in the obtained toner were observed by using a transmission electron microscope (magnification: 2500), and the average particle diameter of the wax was calculated. The results are shown in Table 3. Incidentally, since the shapes of the observed wax were elliptic, the average particle diameter was calculated based on the above equation (1).

TABLE 2

| | Front Roller | | Rear Roller | |
|---|---|---|---|---|
| | Feeding Side | Discharging Side | Feeding Side | Discharging Side |
| Example 8 | 100° C. | 100° C. | 30° C. | 30° C. |
| Example 9 | 110° C. | 110° C. | 30° C. | 30° C. |
| Example 10 | 130° C. | 130° C. | 30° C. | 30° C. |
| Comp.Ex. 4 | 150° C. | 150° C. | 30° C. | 30° C. |
| Comp.Ex. 5 | — | — | — | — |

Comparative Example 5

Composition (3) was subjected to an extrusion kneading by setting a temperature of a twin-screw extrusion kneader (made commercially available by Ikegai K.K. under the trade name: PCM-30) at 110° C. The temperature of the kneaded mixture and the kneading force in the twin-screw extrusion kneader at this time are shown in Table 3. The obtained kneaded mixture for a toner was treated in the same manner as in Example 8, to give a cyan toner having a weight-average particle diameter of 9 [μm]. Thereafter, a colloidal silica was further externally added thereto, to give a developer.

The average particle diameter of the wax in the toner obtained was calculated in the same manner as in Example 8. The results are shown in Table 3.

Evaluation Test

A printing test was carried out using each of the toners obtained in Examples 8 to 10 and Comparative Examples 4 and 5, and the dispersibility of each of the toners used in each of the developers was evaluated by examining the formation of filming on a photoconductor. Incidentally, as the printing test, a durability printing test was carried out by using a TECHTRONIX PHASER 550 (trade name, made commercially available by Kyushu Matsushita Electric Co., Ltd.). The results are shown in Table 3. Incidentally, the evaluation criteria in the table are shown below.

Formation of filming on a photoconductor (properties after continuously copying 10000 sheets)

⊙: No formation of filming.

○: Slight formation of filming, with no problem in practical use.

×: Formation of filming, and generation of background.

Here, the background was evaluated by an areal ratio of background toner per unit area in the non-image forming area, and those having a ratio of 0.1% or more were evaluated as "background generated."

TABLE 3

| | Temperature of Kneaded Mixture [° C.] | | | Average | |
|---|---|---|---|---|---|
| | 0.5 L* | Kneaded Mixture-Discharging Side | Kneading Force [kw Hr/kg] | Particle Diameter of Wax [μm] | Formation of Filming |
| Examples | | | | | |
| 8 | 95 | 94 | 0.8 | 0.6 | ⊙ |
| 9 | 110 | 108 | 0.5 | 1.7 | ⊙ |
| 10 | 125 | 123 | 0.1 | 2.6 | ○ |
| Comparative Examples | | | | | |
| 4 | 140 | 135 | 0.03 | 4.5 | X |
| 5 | — | 155 | 0.02 | 5 or more | X |

*L represents the length of the roller.

As is clear from the results shown in Table 3, in Examples 8 to 10, the temperatures of the kneaded mixtures are low, and the kneading forces are also very large, as compared to those of Comparative Examples 4 and 5.

In addition, it is clear that, in the toners obtained in Examples 8 to 10, the average particle diameters of the waxes in the toners are small, and that the dispersion of the waxes in the toners is excellent, as compared to those of the toners obtained in Comparative Examples 4 and 5.

Preparation of Kneaded Mixture (1)

Polyester resin [glass transition point (Tg): 60° C., melting temperature Tm: 110° C. (acid components: 40 parts by weight terephthalic acid and 60 parts by weight of fumaric acid; and alcohol components: 100 parts by weight of polyoxyethylene(2.0)-2,2-bis(4-hydroxyphenyl)propane)]
70 parts by weight Copper phthalocyanine pigment (C.I. Pigment Blue 15:3)
30 parts by weight The raw materials of the above composition were melted and mixed at 100° C. by using a heat roller mill to prepare Kneaded Mixture (1)

Composition (4)

Kneaded Mixture (1)
17 parts by weight

Polyester resin [the same one as that used in the preparation of Kneaded Mixture (1)]
88 parts by weight Charge control agents Boron complex of benzilic acid (trade name: LR-147, made commercially available by Nippon Carlit K.K.)
1.5 parts by weight Chromium complex of salicylic acid (trade name: E-84, made commercially available by Orient Chemical Co., Ltd.)
1.5 parts by weight

Example 11

To an open roller-type continuous kneader (made commercially available by MITSUI MINING COMPANY, LIMITED under the trade name: KNEADEX) were continuously fed 1.5 kg of the raw materials of the above Composition (4) by using a table feeder. The feed position and the feed amount of each of the raw materials during this process are shown in Table 4. Incidentally, when the feed position of each of the raw materials was the same, a mixture obtained by introducing each of the raw materials into a mixer Henschel mixer (effective capacity: 10 L), and mixing the components at a rotational speed of impellers of 2500 rotations/min for 1 minute, was used.

The open roller-type continuous kneader used during the process had a roller having an outer diameter of 0.14 [m] and an effective length of 0.6 [m]. The operating conditions were as follows: a rotational speed of a high-rotation side roller (front roller) was 75 rotations/min; a rotational speed of a low-rotation side roller (rear roller) was 50 rotations/min; a gap between the rollers was 0.1 mm; temperatures of the heating medium and the cooling medium within the rollers were 100° C. on the raw material-introducing side and 100° C. on the kneaded mixture-discharging side of the high-rotation side roller, and 30° C. on the raw material-introducing side and 30° C. on the kneaded mixture-discharging side of the low-rotation side roller; a feeding rate of the raw material mixture was 10 kg/Hr; and an average residence time was about 2 minutes.

The resulting kneaded mixture for a toner was cooled on a cooling belt, and thereafter roughly pulverized by using a mill having a screen having a diameter ϕ of 2 [mm]. Subsequently, the roughly pulverized product was pulverized by using a collision plate-type jet mill, and the coarse granules and fine powders were eliminated by using a cyclone-type air classifier, to give a cyan toner having a weight-average particle diameter of 9 μm. Incidentally, the weight-average particle diameter of the toner was determined by using Coulter counter. Further, 1.0 part by weight of a hydrophobic silica ("AEROZIL R-972", made commercially available by Nihon Aerozil K.K.) was externally added, based on 100 parts by weight of the resulting toner, to give a developer.

The obtained developer was observed by using a transmission electron microscope (magnification: 2500) for the particle diameter of the charge control agent. As a result, the charge control agent was dispersed in an average particle diameter of 0.3 μm. Further, a 10000-sheet durability printing test was carried out using a commercially available nonmagnetic one-component type full-color electrophotographic recording device comprising a developing roller having a diameter of 15 mm, and as a result, stable fixed images could be obtained.

Example 12

Preparation procedures including melt-kneading were carried out using Composition (4) under the same conditions as in Example 11, except that the feed position and the feed amount of each of the raw materials are as shown in Table 4, to give a developer (weight-average particle diameter: 9 μm). The obtained developer was observed by using a transmission electron microscope (magnification: 2500) for the particle diameter of the charge control agent. As a result, the charge control agent was dispersed in an average particle diameter of 0.5 μm. Further, in a 10000-sheet durability printing test, stable fixed images could be obtained.

Example 13

Preparation procedures including melt-kneading were carried out using Composition (4) under the same conditions as in Example 11, except that the feed position and the feed amount of each of the raw materials are as shown in Table 4, to give a developer (weight-average particle diameter: 9 μm). The obtained developer was observed by using a transmission electron microscope (magnification: 2500) for the particle diameter of the charge control agent. As a result, the charge control agent was dispersed in an average particle diameter of 1 μm. Further, in a 10000-sheet durability printing test, stable fixed images could be obtained.

Example 14

Preparation procedures including melt-kneading were carried out using Composition (4) under the same conditions as in Example 11, except that the feed position and the feed amount of each of the raw materials are as shown in Table 4, to give a developer (weight-average particle diameter: 9 μm). The obtained developer was observed by using a transmission electron microscope (magnification: 2500) for the particle diameter of the charge control agent. As a result, the charge control agent was dispersed in an average particle diameter of 0.5 μm. Further, in a 10000-sheet durability printing test, stable fixed images could be obtained.

Comparative Example 6

Preparation procedures including melt-kneading were carried out using Composition (4) under the same conditions as in Example 11, except that the feed position and the feed amount of each of the raw materials are as shown in Table 4, to give a developer (weight-average particle diameter: 9 μm). The obtained developer was observed by using a transmission electron microscope (magnification: 2500) for the particle diameter of the charge control agent. As a result, the charge control agent was dispersed in an average particle diameter of 3.5 μm. In a 10000-sheet durability printing test, there were caused background, decrease in the transfer ratio and uneven development, owing to poor dispersion of the charge control agent, and stable fixed images could not be obtained.

Composition (5)

Kneaded Mixture (1)

17 parts by weight

Polyester resin [the same one as that used in the preparation of Kneaded Mixture (1)]

88 parts by weight

Charge control agents

Boron complex of benzilic acid 1.5 parts by weight

Chromium complex of salicylic acid 1.5 parts by weight

Carnauba wax 10 parts by weight

Example 15

Preparation procedures including melt-kneading were carried out using Composition (5) under the same conditions as in Example 11, except that the feed position and the feed amount of each of the raw materials are as shown in Table 4, to give a developer (weight-average particle diameter: 9 μm). The obtained developer was observed by using a transmission electron microscope (magnification: 2500) for the particle diameter of the charge control agent. As a result, the charge control agent was dispersed in an average particle diameter of 0.5 μm. Further, in a 10000-sheet durability printing test, stable fixed images could be obtained in an excellent state with no formation of filming on a photoconductor.

Comparative Example 7

Preparation procedures including melt-kneading were carried out in Composition (5) under the same conditions as in Example 11, except that the feed position and the feed amount of each of the raw materials are as shown in Table 4, to give a developer (weight-average particle diameter: 9 μm). The obtained developer was observed by using a transmission electron microscope (magnification: 2500) for the particle diameter of the charge control agent. As a result, the charge control agent was dispersed in an average particle diameter of 3.5 μm. In a 10000-sheet durability printing test, there were caused background, decrease in the transfer ratio and uneven development, owing to poor dispersion of the charge control agent, and stable fixed images could not be obtained.

TABLE 4

| | Kneaded Mixture*1 Feed Position and Feed Amount*2 | | Resin Binder Feed Position and Feed Amount | | Charge Control Agent Feed Position and Feed Amount | | Carnauba Wax Feed Position and Feed Amount | |
|---|---|---|---|---|---|---|---|---|
| Examples | | | | | | | | |
| 11 | 0 L | 100 | 0 L | 100 | 0.3 L | 100 | — | |
| 12 | 0 L | 100 | 0 L | 100 | 0.5 L | 100 | — | |
| 13 | 0 L | 100 | 0 L | 100 | 0.8 L | 100 | — | |
| 14 | 0 L | 100 | 0 L<br>0.5 L | 50<br>50 | 0.5 L | 100 | — | |
| 15 | 0 L | 100 | 0 L | 100 | 0.5 L | 100 | 0.5 L | 100 |
| Comparative Examples | | | | | | | | |
| 6 | 0 L | 100 | 0 L | 100 | 0.95 L | 100 | — | |
| 7 | 0 L | 100 | 0 L | 100 | 0.95 L | 100 | 0.5 L | 100 |

*1A kneaded mixture previously prepared by melting and mixing the colorant in a binder resin.
*2The feed amount is expressed as a divided proportion on part-by-weight basis.

INDUSTRIAL APPLICABILITY

Since the toner obtained according to the present invention is excellent in the dispersion of the colorant and/or wax, the toner can be fixed without using an oil-supplying device. In addition, since the dispersibilities of the charge control agent and the wax are appropriately controlled, the toner can be well used in electrophotographic method, electrostatic printing method, magnetic recording method, and the like.

What is claimed is:

1. A process for manufacturing a toner comprising the step of melt-kneading a composition comprising a resin binder and a colorant using an open roller-type continuous kneader having heating and cooling functions, wherein a plurality of feed openings are provided for melt-kneading along a shaft direction of a roller of the kneader, and wherein melt-kneading is carried out by continuously feeding 6 to 70% by weight of a resin binder to be blended at a position of 0 L to 0.5 L from a roller end at inlet side of the kneader, L being a roller length, and continuously feeding 50 to 100% by weight of a colorant at a position 0 L to 0.5 L.

2. The process according to claim 1, further comprising the step of feeding a charge control agent from one or more feed openings.

3. The process according to claim 1, further comprising the step of feeding a wax from one or more feed openings.

4. A process for manufacturing a toner comprising the step of melt-kneading a composition comprising a resin binder and a colorant using an open roller-type continuous kneader having heating and cooling functions, wherein a composition comprising a resin binder, a colorant, and a wax, wherein the content of the wax is 3 to 20 parts by weight, based on 100 parts by weight of the resin binder, is melt-kneaded using the kneader under the conditions that a temperature of a kneaded mixture during melt-kneading is (Tm−20° C.) to (Tm+20° C.) wherein Tm is a melting temperature of the resin binder.

5. The process according to claim 4, wherein the wax in a toner has an average particle diameter of from 0.1 to 0.3 D $\mu$m, wherein D is a weight-average particle diameter pf the toner, the toner being obtainable by further solidifying, pulverizing and classifying the kneaded mixture.

6. The process according to claim 4, wherein the wax in a toner has an average particle diameter of from 0.5 to 3 $\mu$m, the toner being obtainable by further solidifying, pulverizing and classifying the kneaded mixture.

7. The process according to claim 4, wherein the kneaded mixture is continuously manufactured at a kneading force of from 0.05 to 1.5 kw Hr/kg during melt-kneading.

8. A process for manufacturing a toner comprising the step of melt-kneading a composition comprising a resin binder and a colorant using an open roller-type continuous kneader having heating and cooling functions, wherein a plurality of feed openings are provided for melt-kneading along a shaft direction of a roller of the kneader, and wherein melt-kneading is carried out by continuously feeding a kneaded mixture previously prepared by melt-blending a colorant with a resin binder, a resin binder, and a charge control agent, at a position of 0 L to 0.9 L from a roller end at inlet side of the kneader, L being a roller length.

9. The process according to claim 8, further comprising the step of feeding a wax from one or more feed openings.

* * * * *